US006234053B1

(12) United States Patent
Olsen et al.

(10) Patent No.: US 6,234,053 B1
(45) Date of Patent: May 22, 2001

(54) LABEL STACKER FOR A ROTARY MACHINE/APPARATUS

(75) Inventors: Arne Olsen, Dragør; Steen Olsen, Fredericia, both of (DK)

(73) Assignee: Interket Trykkeri A/S, Stenlose (DK)

( * ) Notice: Subject to any disclaimer, the term of this patent is extended or adjusted under 35 U.S.C. 154(b) by 0 days.

(21) Appl. No.: 09/331,258

(22) PCT Filed: Dec. 17, 1997

(86) PCT No.: PCT/DK97/00577

§ 371 Date: Jun. 18, 1999

§ 102(e) Date: Jun. 18, 1999

(87) PCT Pub. No.: WO98/28192

PCT Pub. Date: Jul. 2, 1998

(30) Foreign Application Priority Data

Dec. 20, 1996 (DK) ..... 1492/96

(51) Int. Cl.[7] ..... B65H 29/24

(52) U.S. Cl. ..... 83/88; 83/99; 83/155; 83/161; 83/949

(58) Field of Search ..... 83/88, 84, 86, 83/100, 152, 85, 649, 949, 105, 106, 177, 99, 155, 161; 271/185, 197, 183

(56) References Cited

U.S. PATENT DOCUMENTS

| | | | | |
|---|---|---|---|---|
| 3,255,652 | | 6/1966 | Linden | 83/88 |
| 4,189,140 | | 2/1980 | Swanson | 271/212 |
| 4,200,016 | | 4/1980 | Helmig et al. | 83/88 |
| 4,224,850 | * | 9/1980 | Holmi et al. | 83/105 |
| 4,285,257 | * | 8/1981 | Eberle et al. | 83/100 |
| 4,345,496 | * | 8/1982 | Pearl | 83/100 |
| 4,534,550 | | 8/1985 | Reist | 271/183 |
| 4,598,901 | | 7/1986 | Thomas | 271/202 |
| 4,987,809 | | 1/1991 | Price | 83/27 |
| 5,156,075 | * | 10/1992 | Campbell, Jr. et al. | 83/100 |
| 5,193,423 | * | 3/1993 | Bakker | 83/152 |
| 5,531,313 | | 7/1996 | Maass | 198/689.1 |
| 5,651,313 | * | 7/1997 | Kowalewski et al. | 271/197 |
| 5,697,606 | * | 12/1997 | Maass | 271/197 |
| 5,699,707 | * | 12/1997 | Campbell, Jr. | 83/152 |
| 5,730,440 | * | 3/1998 | Motooka | 271/197 |

FOREIGN PATENT DOCUMENTS

| | | |
|---|---|---|
| 46853/85 | 10/1986 | (AU) . |
| 2320902 | 11/1973 | (DE) . |
| 2601081 | 7/1977 | (DE) . |
| 1577158 | 10/1980 | (GB) . |
| 2046711 | 11/1980 | (GB) . |
| 2147570 | 5/1985 | (GB) . |
| 9405547 | 3/1994 | (WO) . |

* cited by examiner

*Primary Examiner*—Rinaldi I. Rada
*Assistant Examiner*—Omar Flores-Sánchez
(74) *Attorney, Agent, or Firm*—Pennie & Edmonds LLP

(57) ABSTRACT

A label stacker for stacking labels (6) from a rotary punching apparatus is provided with a punching roll (14) with cutting edges (16) and a smooth counter-pressure roll (15) for, during operation, jointly punching labels out of a thin web (3) conveyed between the rolls while these are rotating in different directions. The label stacker includes a belt conveyor with at least one endless belt (27) which, during operation, is driven with a lower speed than the circumferential speed of the rolls about a first rotating roll (29) at the discharge end of the rolls and a second rotating roll (30) at the stacking area. Thereby, the label stacker is given a compact structure, and it will be able to safely control the labels to the stacking area in an orderly formation which successively, during the final stacking, is pushed together to a stack of labels arranged correctly on top of each other.

11 Claims, 7 Drawing Sheets

LABEL STACKER FOR A ROTARY MACHINE/APPARATUS

FIELD OF THE INVENTION

The invention concerns a label stacker for a rotary punching apparatus having a punching roll with cutting edges and a smooth counter-pressure roll for, during operation, jointly punching labels out of a thin web conveyed between the rolls while these are rotating in different directions.

BACKGROUND

Labels are normally printed on thin webs of plastic film or paper of thicknesses down to 0.01 mm. The thin labels leave the rotary punching apparatus with a speed of e.g. 5.0 m/sec. With such high speeds, it has turned out to be difficult to control the label flow from the rotary punching apparatus and get the labels stacked correctly in the stacking area. The label stacker will furthermore have a considerable linear extent, because the rotary punching apparatus with the above speed sends out a label flow of a length of 50 m to the label stacker each second.

An object of the invention is to provide a label stacker of the kind mentioned in the opening paragraph, which has a compact structure, and which can effectively control the label flow from the rotary punching apparatus and be certain to stack the labels in orderly stacks in the stacking area.

SUMMARY OF THE INVENTION

According to the present invention, the label stacker includes a belt conveyor with at least one endless conveyor belt that, during operation, is driven with a lower speed than the circumferential speed of the rolls about a first rotating roll at the discharge end of the rolls and a second rotating roll at the stacking area. In this way, the labels in the label flow will be made to overlap each other on the conveyor and, therefore, can be dimensioned with a correspondingly smaller linear extent. The reduced conveying speed furthermore means that the label flow can be properly controlled to the stacking area, and the labels are therefore certain to be stacked in orderly stacks. The stacking is facilitated, because the labels have been made to overlap each other already on the belt. This formation only needs to be pushed together to form the finished stack.

The rotary punching apparatus puts, with great regularity, each of the punched labels down in a specific place in the formation of labels on the conveyor belt. In order to avoid that the finished stack of labels becomes disarranged, it is important that each label remains exactly in its place in the formation all the way to the final stacking operation.

To obtain this, the conveyor belt, which typically can be made of an elastomer, can be perforated and subjected to a differential pressure for sticking the labels to the belt by means of a low pressure along the underside of the belt.

The negative pressure can, in an advantageous embodiment, be made by enclosing the belt with an open body connected to a vacuum source and by letting the belt part of the conveyor run close to the opening of the body.

The labels are thin and light. The air resistance they encounter during conveyance to the stacking area is therefore likely to blow them up and tear them off the conveyor belt or disarrange the formation. To avoid this, an air duct can, according to the invention, be placed above the belt part of the conveyor. Air flows through this air duct with a greater speed than the conveying speed in the conveyance direction and serves for keeping the labels down. Therefore, the air flow has the useful effect of preventing the labels from getting up and being disarranged or torn off, because the labels meet air resistance during transportation on the belt conveyor.

The air flow can, in an advantageous embodiment, be coming from a second air duct connected to a compressed-air source, and which, at the first rotating roll, pass into the first air duct. In the transition of the two ducts, there can furthermore be placed a number of reversing blades for, already from the beginning, ensuring that the air flow is blown evenly and regularly over the formation of labels on the conveyor belt and will therefore not, in itself, disarrange the formation.

The air speed through the first air duct can be regulated in the longitudinal direction by letting the upper wall of the first air duct be pivotally hinged to the second air duct at the transition from the first air duct to the second. The upper wall can, e.g., be put in such that the cross section of the first air duct is gradually decreasing in the conveyance direction, whereby the air speed is proportionally increased. Thereby, the labels are advantageously pressed even harder down on the conveyor belt until finally being safely blown into, e.g., a case for stacking the labels. At the same time, there is compensated for the amount of air drawn through the belt.

The geometry in the area between the discharge end of the rolls and the belt part of the conveyor means that an open gap will necessarily be made here into which the labels can fall down, or which can cause them to be placed in a disadvantageous way on the conveyor belt. To eliminate this disadvantage, a bridge can be placed extending between the counter-pressure roll and the start of the belt part of the conveyor, so that the labels are also supported entirely in this area. The top side of the bridge can advantageously be smooth so that the labels do not encounter any resistance of importance when they are sliding across the bridge.

The belt conveyor can have just one belt, and in this case, the labels will be conveyed at the same speed all the way. However, when the belt conveyor has several successively placed belts running with speeds which are decreasing with every belt, the label flow will be slown proportionally down before the final stacking operation which furthermore can take place safely and effectively, as the labels in the formation, now already in advance, are pushed almost together and therefore only need to be pushed together a short distance to cover each other in the finished label stack.

BRIEF DESCRIPTION OF THE DRAWINGS

The present invention will be explained in greater details below, describing only exemplary embodiments with reference to the drawing, in which.

DETAILED DESCRIPTION OF A PREFERRED EMBODIMENT

Figure 1:
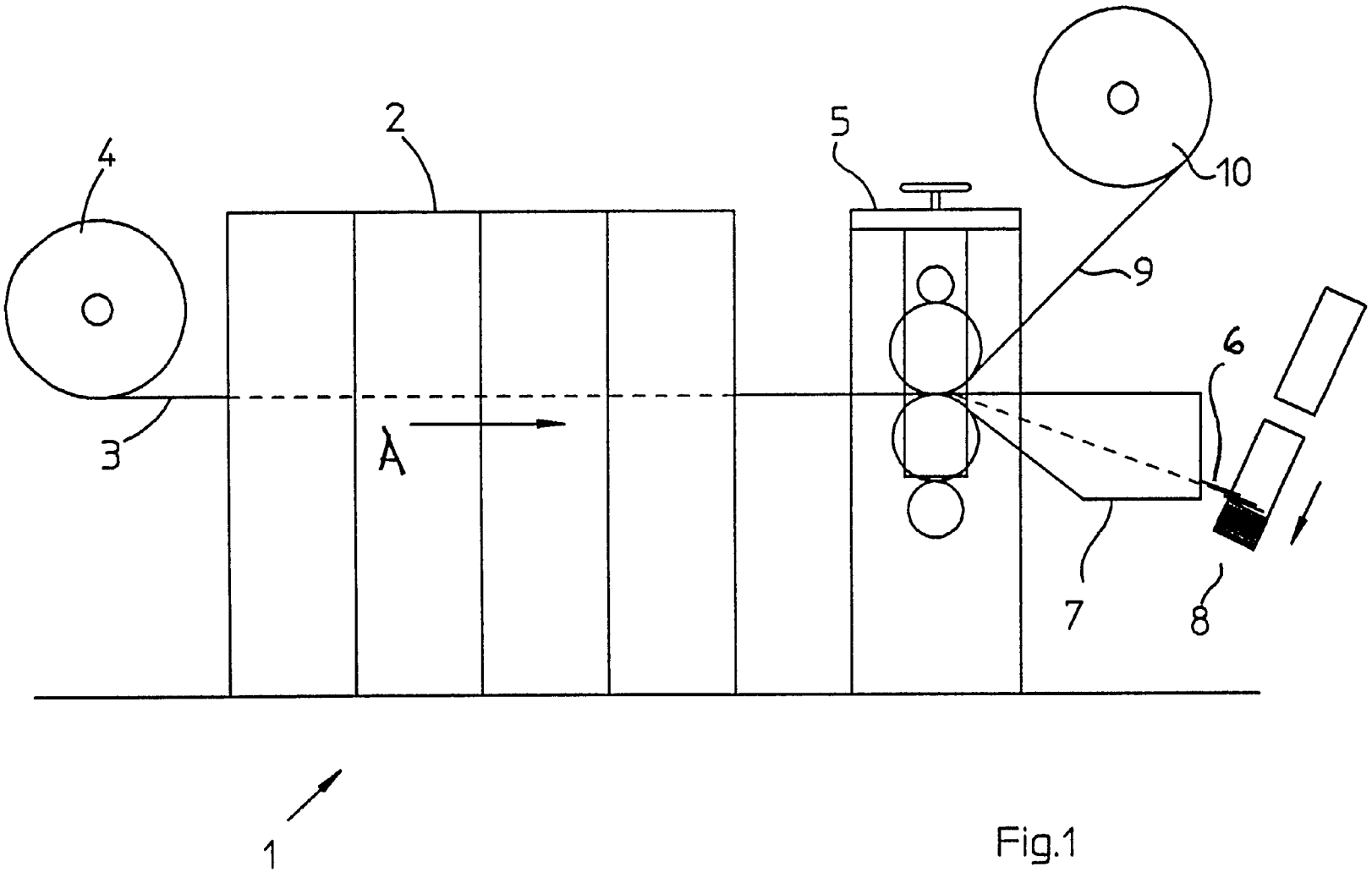
FIG. 1 is a schematic view of an apparatus for manufacturing labels according to the present invention.

FIG. 1 shows an apparatus for manufacturing labels. The apparatus includes an inking apparatus 2 for printing the labels on a label web 3 from a supply roll 4 and a rotary punching apparatus 5 for punching the printed labels 6 out of the label web 3.

Figure 2:
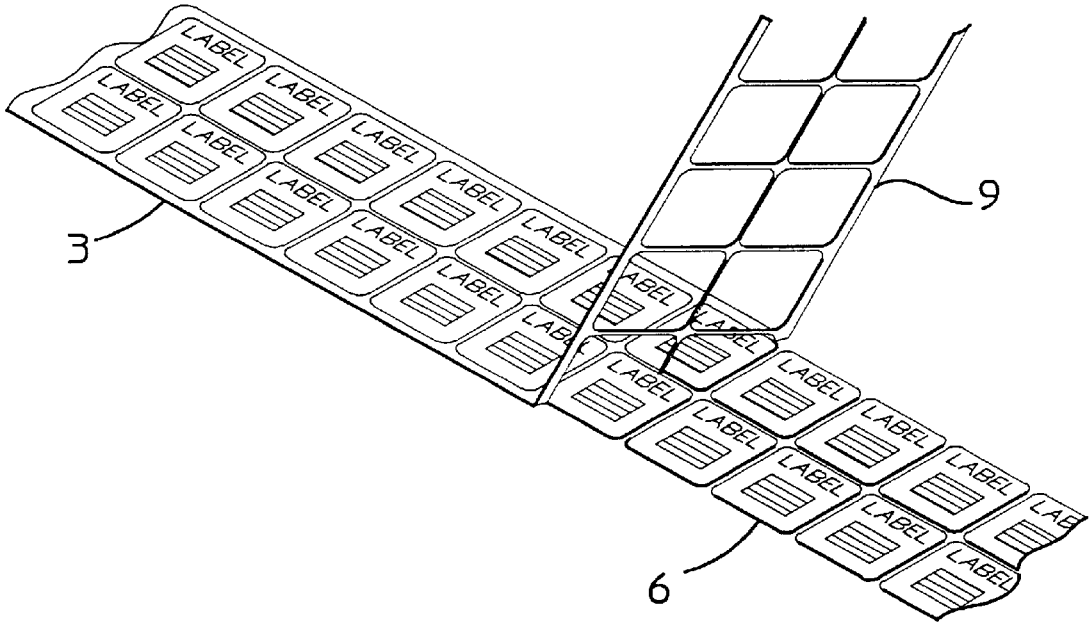
FIG. 2 is a perspective view of a label web and some punched labels made according to the present invention.

During operation, the label web 3 is conveyed through the apparatus 1 in the direction of the arrow A. When passing the rotary punching apparatus 5, the labels 6 are punched out of the label web 3, as shown in FIG. 2.

The labels are led to a label stacker 7 for stacking the labels in a case 8 while the remaining tape waste 9 is wound up into a waste roll 10.

Figure 3:
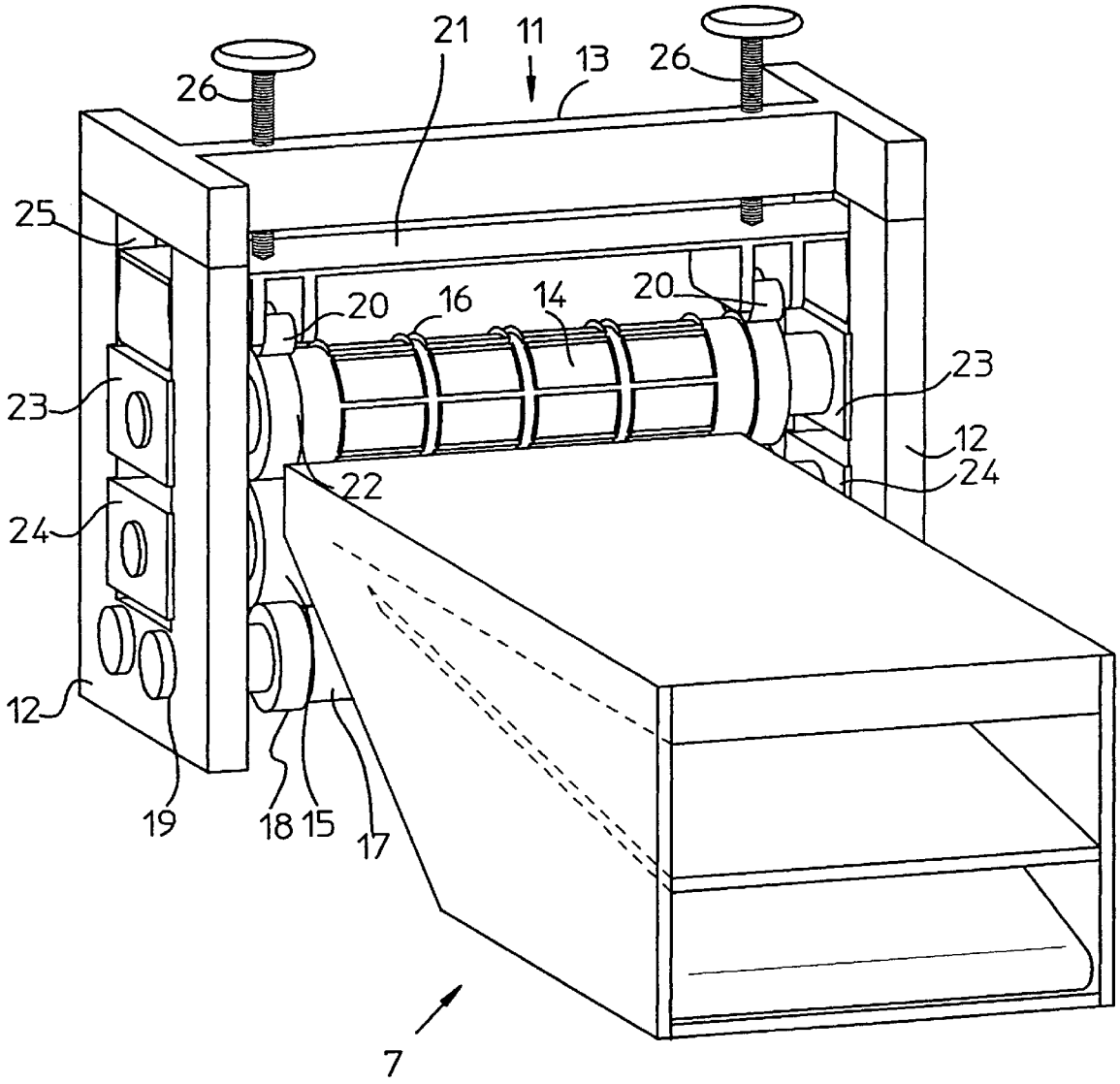
FIG. 3 is a perspective view of a rotary punching apparatus with a label stacker according to the present invention.

FIG. 3 shows, in perspective, a rotary punching apparatus with a label stacker 7. The rotary punching apparatus is constructed around a stand 11 which principally consists of two guideways 12 connected with a cross member 13.

On the stand, a punching roll 14 and a counter-pressure roll 15 are rotatably mounted. The punching roll has raised cutting edges 16 for, jointly with the counter-pressure roll, punching the labels 6 out of the label web 3.

The counter-pressure roll is supported by two support rolls 17 with, at each end, a journal 18 which runs on the counter-pressure roll 15. The support rolls 17 are rotatably journaled in bearings 19 made in the guideways 12.

The punching roll is supported by a pair of rollers 20 rotatably mounted in a cross bar 21. The rollers run on journals 22 made on each end of the punching roll 14.

The punching roll 14 and the counter-pressure roll 15 are journaled in bearing housings, 23 and 24 respectively, and the bearing housings can be displaced up and down in guides 25 in the guideways 12. The same is the case for the cross bar 21 which thereby, by means of adjusting screws 26, can tighten the rollers 20 to the journals of the punching roll and put the rotary punching apparatus in operational order.

Figure 4:
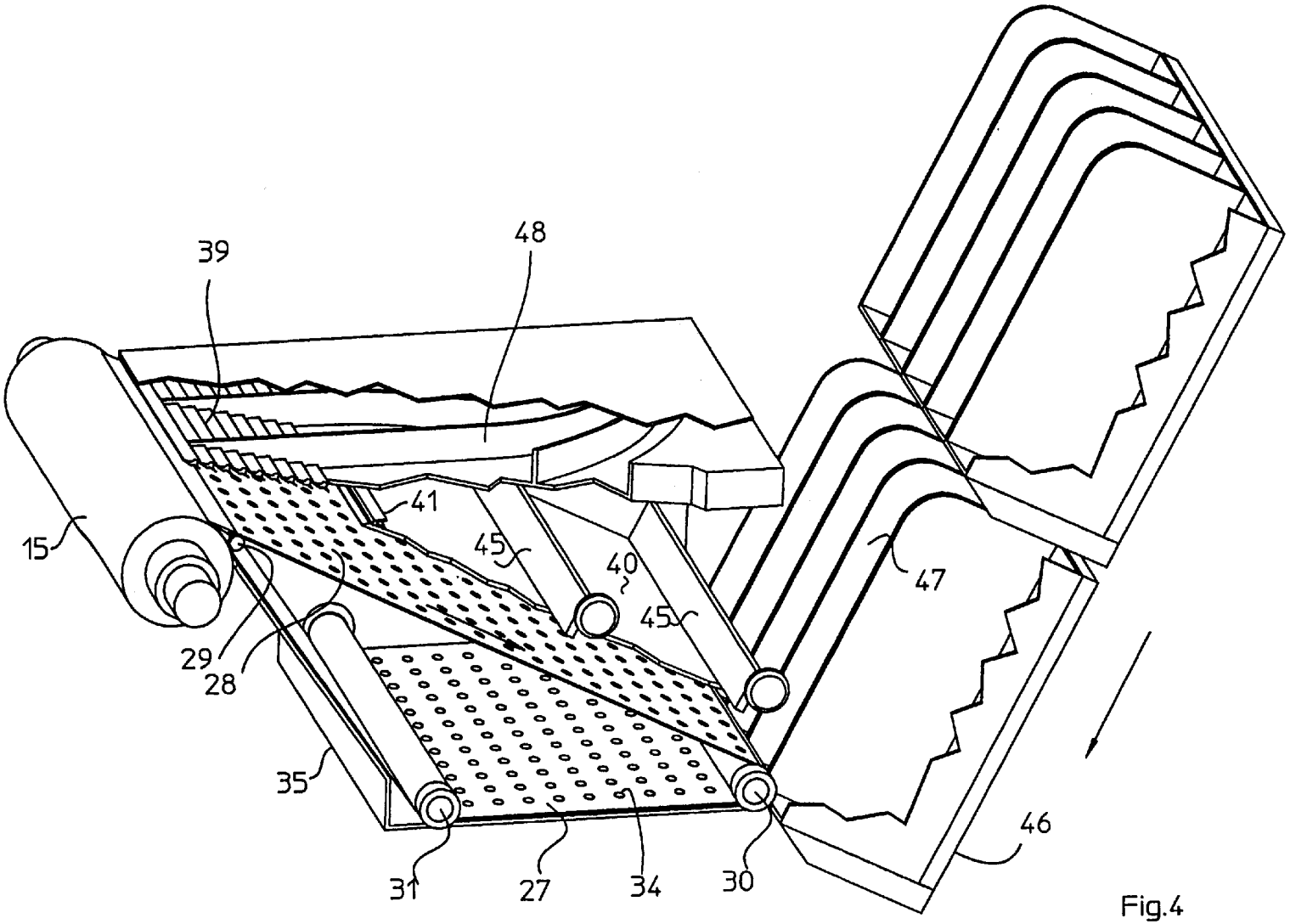
FIG. 4 is a perspective cutaway view from a first side of a first embodiment of a label stacker and two cases for carrying the labels according to the invention.
Figure 5:
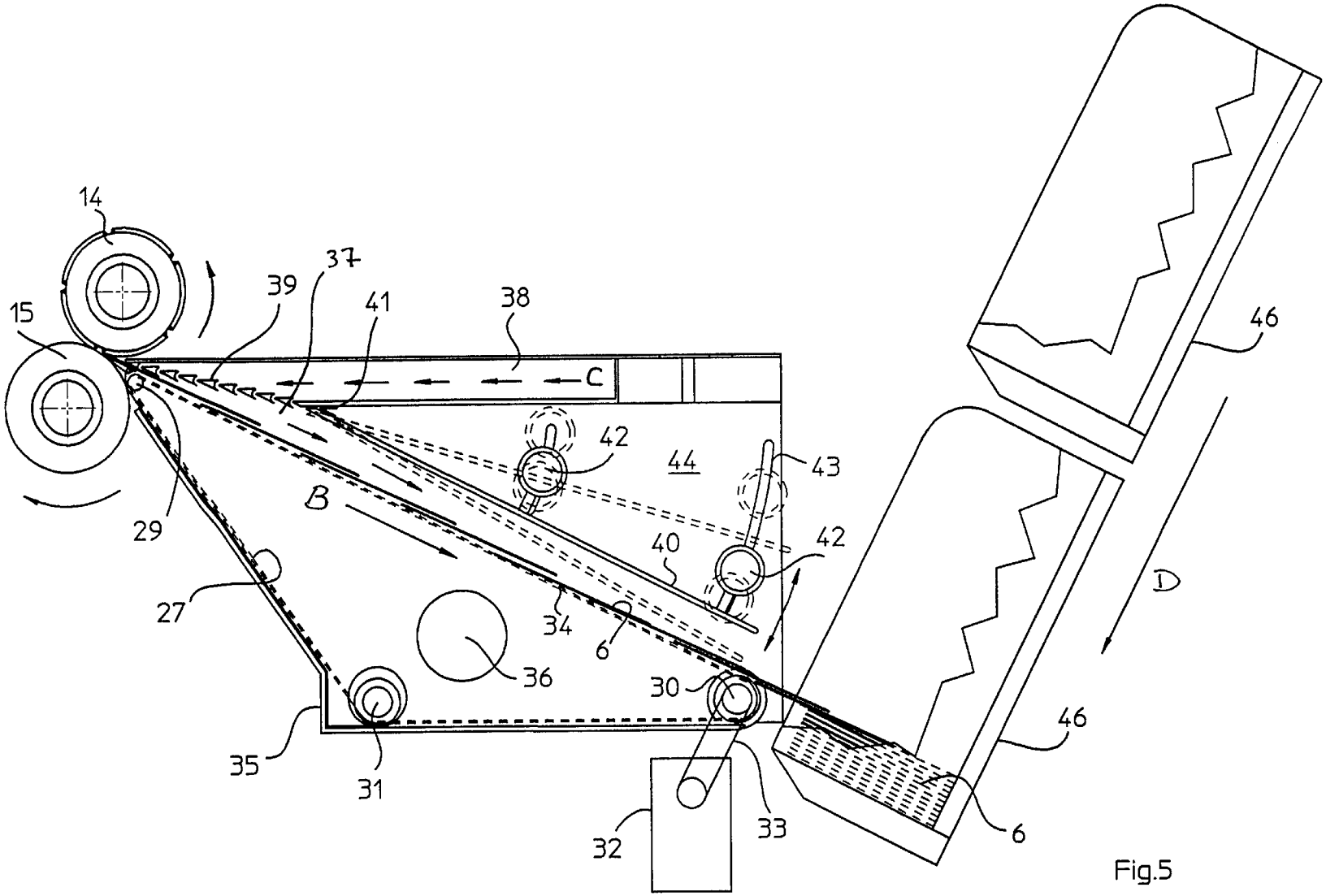
FIG. 5. is an elevational cutaway view thereof.

FIGS. 4 and 5 show a first embodiment of a label stacker according to the present invention. A conveyor 27 with a top conveyor face 28 runs on a first rotating roller 29 at the discharge end of the rolls 14, 15, a second rotating roller 30 at an area for stacking labels, and a tension pulley 31 for keeping the belt adequately tight. A driving device 32 serves for, via a belt drive 33, driving the conveyor 27 in the direction of the arrow B.

The conveyor belt is perforated by a number of evenly distributed holes 34 and enclosed by an open body 35 connected with a vacuum source (not shown) via a pipe connection 36. The conveyor part 28 of the conveyor runs close to the opening of the body, and a differential pressure will therefore be produced above the belt for sticking the labels to the belt.

Above the conveyor part 28, a first air duct 37 is arranged which, at the discharge end of the rolls 14, 15, passes into a second air duct 38 connected to a compressed-air source (not shown) for generating an air flow through the two ducts in the direction of the arrows C. In the transition of the two ducts 37, 38, a number of transverse guiding blades have been arranged for leading the air from the second air duct 38 into the first air duct 37 in the right direction and in a steady flow which, in itself, will not be likely to disarrange the label formation at the start of the belt.

The air in the first duct 37 flows over the labels in follow and with a greater speed than the conveyance speed of the conveyor belt. The air flow will therefore prevent the labels from rising and being disarranged or being torn off because they encounter air resistance during the conveyance on the conveyor belt.

The upper wall 40 of the first air duct 37 is, with a hinge 41, pivotally fastened on the underside of the second air duct 38 at the transition of the two ducts 37, 38. The upper wall 40 can therefore be swung from a position of decreasing duct cross section in the conveyance direction to a position of increasing cross section in the conveyance direction. The setting is done by means of adjusting screws 42 which run in curved slits 43 made in side walls 44 in the label stacker. The adjusting screws are tightened to cross bars 45 on the upper wall 40.

By swinging the upper wall 40 of the first air duct 37 down towards the conveyor part 28 of the conveyor, the air speed through the first air duct can gradually be increased towards the exit of the duct. Thereby, the labels are pressed even harder down on the belt by an air flow with sufficient force to safely blow the labels into the shown case 46 with partitions 47 for carrying the individual label stacks.

Depending on the arrangement of the stacking area, it could be an advantage to let the air speed through the first air duct decrease towards the exit, where the labels then are easily separated from each other to individually fall down and be collected in a stack. The upper wall 40 will, in this case, have to be swung up, so that the cross section of the first air duct is increased in the conveyance direction.

It is important that the air is flowing through the first air duct with a transversely uniform speed, as the air flow otherwise would influence the labels with a moment likely to shift the labels on the belt 28. Therefore, guiding plates 48 have been arranged in the second air duct 38 for transversely distributing the air evenly, before the air flows, via the reversing blades 39, reach the first air duct.

Figure 6:
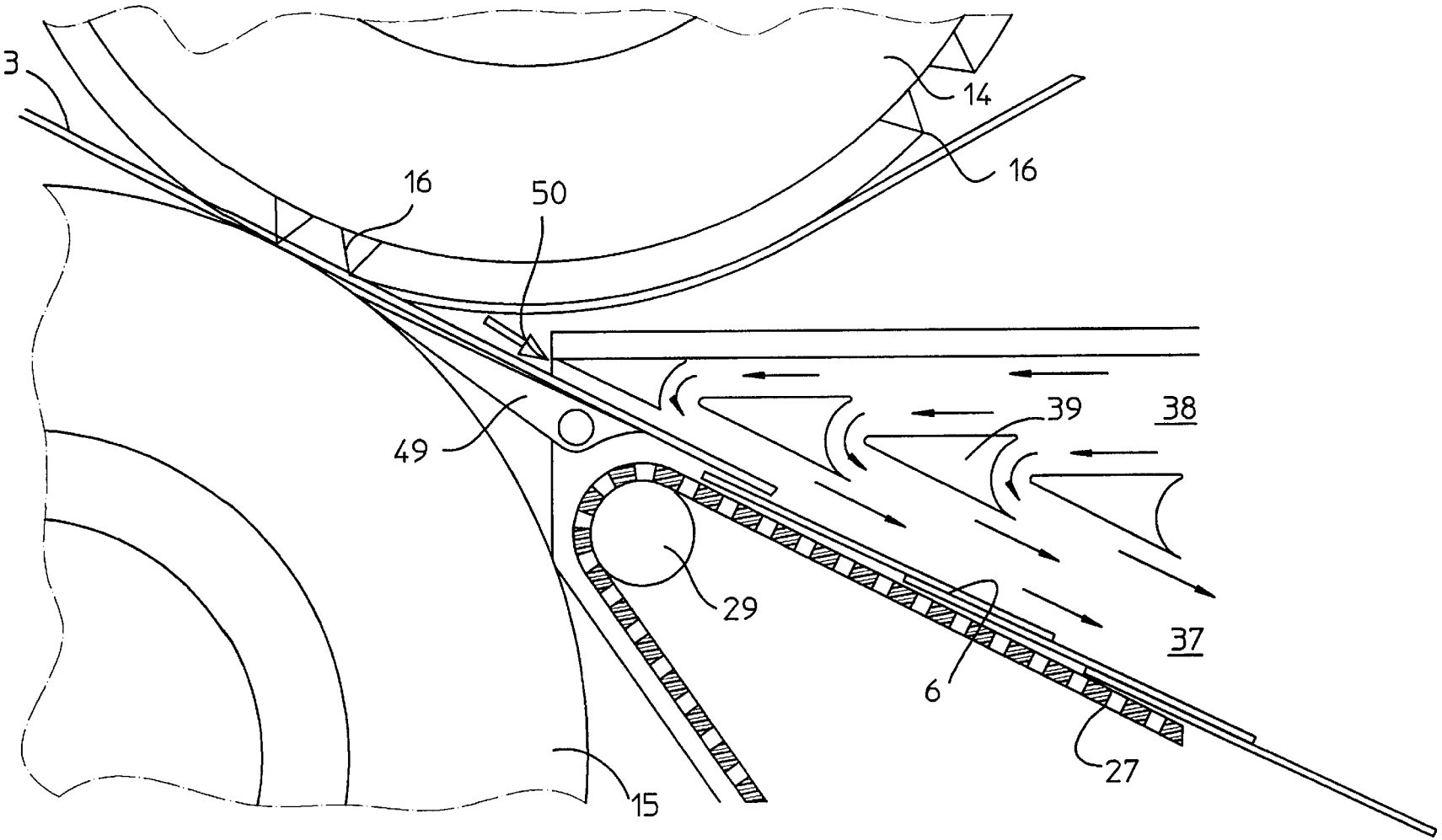
FIG. 6 is an exploded partial view of the area at the discharge end of the rolls and the entrance of the label stacker.

FIG. 6 shows, on an enlarged scale and from the side, the area at the discharge end of the rolls and at the start of the label stacker. Due to the final curve of the rolls 14, 15 and the first rotating roller 29, there is an open gap in this area without support for the labels which therefore can fall down or be disarranged on the belt. To avoid this disadvantage, a bridge 49 has been placed between the discharge end of the rolls and the belt at the first rotating roller 29 to, also in this area, support the labels. The bridge surface is smooth to ensure that the labels easily and unhampered can slide across the bridge.

During the fast rotation of the rolls, the cutting edges 16 on the punching roll 14 will function as a ventilator sending a strong air flow across the bridge 49 in the direction of the opening 50 at the receiving end of the label stacker. This air flow ensures, together with the inertia of the labels, that the labels are conveyed across the bridge 49 and onto the conveyor 27 onto which the labels then are stuck and conveyed through the label stacker. The air flow from the cutting edges of the punching rolls also prevents some of the air flowing in the first and second air duct 37 and 38 from flowing through the opening 50 and blowing the labels backwards.

The conveyance speed of the conveyor belt can be adjusted to the speed most suited for labels of a specific thickness, weight, and size.

It is however an essential characteristic of the label stacker according to the invention that its conveyor belt is driven with a speed slightly slower than the circumferential speed of the rolls. For this causes the labels to overlap each other on the belt which therefore can be dimensioned with a correspondingly shorter length. At the same time, it is easier to form the labels on the conveyor belt and keep the formed formation intact to the stacking area. Moreover, the stacking passes off quickly and safely because the labels, already on the conveyor belt, are partly pushed in over each other, and it is only necessary to finally push the label formation approaching the stacking area a short distance together to form a finished stack of labels.

The last-mentioned process is best illustrated in FIG. 5, where it can be seen that the formation successively is pushed together in the case 46 which is lowered in the direction of the arrow D concurrently with the label stack growing. When the first case is full, a new, empty case is immediately ready to be filled.

It has turned out to be advantageous when the conveyor belt is driven with a speed of between 0.1 and 0.9, preferably between 0.1 and 0.7, and more preferably between 0.1 and 0.6 times the circumferential speed of the rolls.

Figure 7:
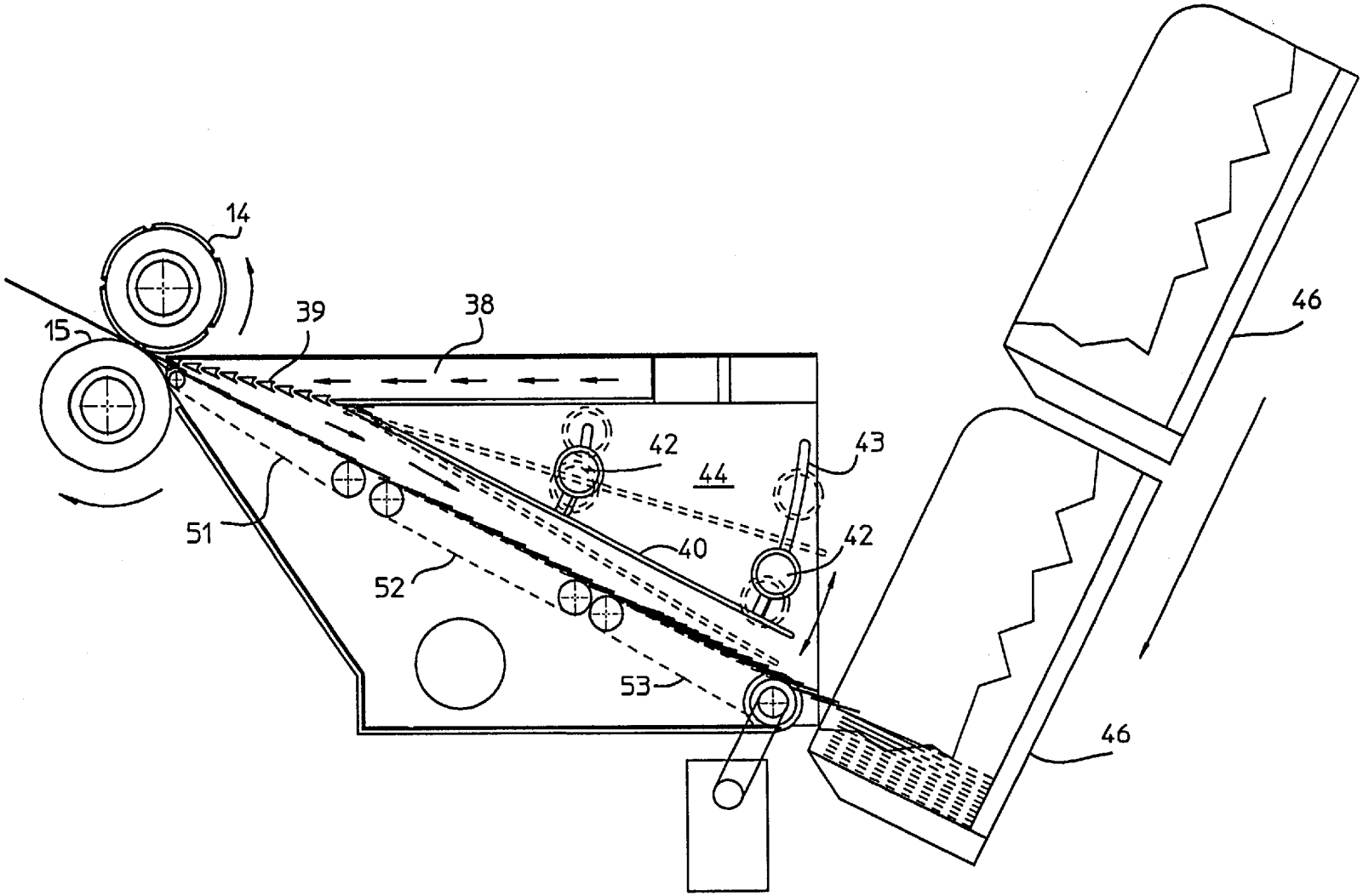
FIG. 7 is an elevational cutaway view of a second embodiment of a label stacker and two cases for carrying the labels according to the present invention.

FIG. 7 shows a second embodiment of a label stacker according to the present invention. In this case, three conveyor belts 51, 52, and 53 have been placed one behind the other. Each conveyor belt in the line is driven with a slightly lower speed than the previous one, and the labels with therefore, belt by belt, be pushed further over each other, so that they, in the end, only have to be pushed a short distance together to be on top of each other in a finished stack. During the stacking operation, the labels have furthermore been slown down so much that they now can be stacked safely and effectively. Apart from these differences in mode of operation, the second embodiment is moreover constructed entirely as the first embodiment shown in FIGS. 4 and 5, and its structure will therefore not be further described here.

The embodiments shown in the drawings and described herein are specified with the punching roll with associated supports at the top and the counter-pressure roll with associated supports at the bottom. It goes without saying that the constellation just as well can be reversed within the scope of the invention.

What is claimed is:

1. A label stacker for a rotary punching apparatus comprising a punching roll with cutting edges and a smooth counter-pressure roll for, during operation, jointly punching labels out of a thin web conveyed between the punching and counter-pressure rolls while these are rotating in different directions, wherein the label stacker comprises a belt conveyor with at least one endless, air-permeable conveyor belt which has a conveyor part for conveying the punched labels to a stacking area, and which, at a lower speed than a circumferential speed of the punching and counter-pressure rolls during operation, runs about a first rotating roll at the discharge end of the punching and counter-pressure rolls and a second rotating roll at the stacking area, and a means for producing a low pressure along the underside of the belt conveyor comprising, above the belt part of the conveyor, a first air duct which ends at the second rotating roll, and which, at the first rotating roll, passes into a second air duct which is connected to a compressed-air source for, in the second and first air duct, generating an air flow which leaves the ducts via a mouth of the first air duct.

2. A label stacker according to claim 1, wherein the velocity of the air flow in the first air duct is higher than the speed of the conveyor belt.

3. A label stacker according to claim 1, further comprising a plurality of reversing blades disposed crosswise in a transition between the first and the second ducts.

4. A label stacker according to claim 1, wherein an upper wall of the first air duct is pivotally hinged to the second air duct at a transition between the two ducts.

5. A label stacker according to claim 1, further comprising at least one case disposed in the stacking area, the case is made to, during operation, be conveyed mainly transversely to the conveyor belt, and serves to successively carry the labels in a stack via a longitudinal opening facing the labels in the at least one case.

6. A label stacker according to claim 5, wherein the at least one case has a backwards inclined back wall placed oppositely to the opening, and a lower bottom for supporting the stacked labels.

7. A label stacker according to claim 1, wherein the velocity of the air flow in the first air duct is higher than the speed of the conveyor belt placed adjacent the stacking area.

8. A label stacker according to claim 1, wherein the means for punching a low pressure along the underside of the belt further comprises an open body connected to a vacuum source, and that the conveyor part of the conveyor runs close to an opening of the open body.

9. The apparatus of claim 1, wherein said air duct is placed above the belt part of the conveyor, so that the air flows through the air duct with a greater speed than the conveying speed in the conveyance direction, thereby keeping the labels from being disarranged or torn off during transportation.

10. A label stacker for a rotary punching apparatus comprising a punching roll with cutting edges and a smooth counter-pressure roll for, during operation, jointly punching labels out of a thin web conveyed between the punching and counter-pressure rolls while these are rotating in different directions, wherein the label stacker comprises a belt conveyor, wherein the belt conveyor comprises a plurality of belts arranged in succession and driven at speeds which are decreasing with each successive belt, each belt having a conveyor part for conveying the punched labels to a stacking area, and which, at a lower speed than a circumferential speed of the punching and counter-pressure rolls during operation, runs about a first rotating roll at the discharge end of the punching and counter-pressure rolls and a second rotating roll at the stacking area, and a means for producing a low pressure along the underside of the belt conveyor comprising, above the belt part of the conveyor, a first air duct which ends at the second rotating roll, and which, at the first rotating roll, passes into a second air duct which is connected to a compressed-air source for, in the second and first air duct, generating an air flow which leaves the ducts via a mouth of the first air duct.

11. A label stacker for a rotary punching apparatus comprising a punching roll with cutting edges and a smooth counter-pressure roll for, during operation, jointly punching labels out of a thin web conveyed between the punching and counter-pressure rolls while these are rotating in different directions, wherein the label stacker comprises a belt conveyor with at least one endless, air-permeable conveyor belt which has a conveyor part for conveying the punched labels to a stacking area, and which, at a lower speed than a circumferential speed of the punching and counter-pressure rolls during operation, runs about a first rotating roll at the discharge end of the punching and counter-pressure rolls and a second rotating roll at the stacking area, and a means for producing a low pressure along the underside of the belt conveyor comprising, above the belt part of the conveyor, a first air duct which ends at the second rotating roll, and which, at the first rotating roll, passes into a second air duct which is connected to a compressed-air source for, in the second and first air duct, generating an air flow which leaves the ducts via a mouth of the first air duct, wherein the speed of the conveyor belt is between 0.1 and 0.9 times the circumferential speed of the punching and counter-pressure rolls.

* * * * *